US008176899B2

(12) United States Patent
Lee

(10) Patent No.: US 8,176,899 B2
(45) Date of Patent: May 15, 2012

(54) DEVICE FOR ACCELERATING COMBUSTION OF LIQUID FUEL AND SYSTEM FOR ACCELERATING COMBUSTION OF LIQUID FUEL FOR INTERNAL COMBUSTION ENGINE

(76) Inventor: Dong Jae Lee, Busan (KR)

( * ) Notice: Subject to any disclaimer, the term of this patent is extended or adjusted under 35 U.S.C. 154(b) by 539 days.

(21) Appl. No.: 12/095,714

(22) PCT Filed: Dec. 29, 2006

(86) PCT No.: PCT/KR2006/005880

§ 371 (c)(1),
(2), (4) Date: Nov. 17, 2008

(87) PCT Pub. No.: WO2007/145409

PCT Pub. Date: Dec. 21, 2007

(65) Prior Publication Data

US 2010/0147237 A1 Jun. 17, 2010

(30) Foreign Application Priority Data

Jun. 14, 2005 (KR) ..... 20-2006-0015938 U
Jun. 14, 2006 (KR) ..... 10-2006-0053268

(51) Int. Cl.
*F02M 27/00* (2006.01)

(52) U.S. Cl. ..... 123/538

(58) Field of Classification Search ..... 123/536–538; 210/222, 695

See application file for complete search history.

(56) References Cited

U.S. PATENT DOCUMENTS

| | | | | |
|---|---|---|---|---|
| 5,044,346 | A * | 9/1991 | Tada et al. | 123/536 |
| 5,108,618 | A | 4/1992 | Hirasawa et al. | |
| 5,124,045 | A * | 6/1992 | Janczak et al. | 123/538 |
| 5,524,594 | A * | 6/1996 | D'Alessandro | 123/538 |
| 6,024,073 | A * | 2/2000 | Butt | 123/538 |
| 6,220,231 | B1 * | 4/2001 | Kobayashi | 123/538 |
| 6,386,187 | B1 * | 5/2002 | Phykitt | 123/538 |
| 6,439,207 | B1 * | 8/2002 | Liu | 123/536 |
| 6,807,953 | B1 * | 10/2004 | Liao | 123/538 |
| 7,287,520 | B2 * | 10/2007 | Hashimoto et al. | 123/538 |
| 2002/0040707 | A1 * | 4/2002 | Ratner et al. | 123/538 |
| 2006/0260588 | A1 * | 11/2006 | Keiichiro et al. | 123/538 |

FOREIGN PATENT DOCUMENTS

| | | | |
|---|---|---|---|
| JP | 10-047173 | A | 2/1998 |
| JP | 10047173 | A * | 2/1998 |
| JP | 11-012022 | A | 1/1999 |
| JP | 2005344700 | A * | 12/2005 |
| KR | 10-2002-0088685 | A | 11/2002 |
| KR | 20-0314262 | Y1 | 5/2003 |
| KR | 10-2004-0033872 | A | 5/2004 |

* cited by examiner

*Primary Examiner* — M. McMahon
(74) *Attorney, Agent, or Firm* — Birch, Stewart, Kolasch & Birch, LLP

(57) ABSTRACT

The present invention relates to a device for accelerating the combustion of liquid fuel for improving the combustion efficiency of liquid fuel used in an internal combustion engine and a system for accelerating the combustion of liquid fuel using the device. The device is characterized in that magnets are provided in a metal pipe, and pure tourmaline ceramics and mixed tourmaline ceramics are used as a catalyst, so that fuel molecules are atomized by the magnetic field, generated by the magnets, and by far infrared rays, radioactive rays, and the like generated from the catalyst, thereby accelerating the combustion of fuel. The internal combustion engine using the device and system of the present invention can realize fuel savings and can reduce the discharge of environmental pollutants.

1 Claim, 5 Drawing Sheets

DEVICE FOR ACCELERATING COMBUSTION OF LIQUID FUEL AND SYSTEM FOR ACCELERATING COMBUSTION OF LIQUID FUEL FOR INTERNAL COMBUSTION ENGINE

TECHNICAL FIELD

The present invention relates to a device for accelerating the combustion of liquid fuel for improving the combustion efficiency of liquid fuel used in an internal combustion engine, and to a system for accelerating the combustion of liquid fuel using the device.

BACKGROUND ART

The amount of energy used is increasing along with industrialization, and thus environmental pollution is gradually becoming more serious. In order to overcome related environmental and energy problems, it is very important to maximize the combustion efficiency of petroleum and minimize the discharge of harmful exhaust gas. There are various methods for increasing the combustion efficiency of fuel and preventing the discharge of environmental pollutants.

Among the above methods, the most commonly used methods are classified into a method of atomizing liquid fuel particles using a catalyst, a method of magnetizing liquid fuel particles using a magnetic field, and a method of spraying fuel. Technologies based on these conventional methods will be described below.

FIG. 1 is a schematic view showing a fuel saving system in which a magnetic field is used to atomize liquid fuel particles.

As shown in FIG. 1, a gasoline engine 3 is connected with a fuel tank 2 through a gasoline supply pipe 6, and the pipe 6 is provided with a magnet 13 on the outer wall thereof. Since a magnetic field is generated between the two poles of the magnet 13, the materials located in the magnetic field are influenced by the magnetic field, and thus charged particles are controlled or fuel material is activated. Accordingly, aggregates of fuel particles flowing in the pipe 6 are atomized into respective particles under the influence of the magnetic field of the magnet 13, thereby improving the combustion efficiency of fuel. However, the above technology has a problem in that, since the magnet 13 is disposed outside the pipe 6, the magnetic force applied to the fuel is decreased, thereby decreasing the efficiency of conversion of fuel into good-quality fuel. As a method of overcoming the problem, a technology of placing a magnet inside a pipe or increasing the number of magnets has also been known.

Since it had been limited to increase the combustion efficiency of fuel using a magnet, as shown in FIG. 2, a technology of increasing the combustion efficiency of fuel using a catalyst was also developed. This technology is a technology of improving the combustion efficiency of fuel through catalysis by causing the fuel to pass through a pipe 4 in which spherical catalyst particles 15 are introduced. However, the spherical catalyst has a problem in that, since it has a small area in contact with fuel and low porosity, flow resistance is generated, so that fuel is not smoothly supplied, with the result that it is difficult to implement it in internal combustion engines.

As another method for overcoming the problem, Korean Patent Application No. 10-2004-0033872 discloses a device for accelerating the combustion of fuel for internal combustion engines. FIG. 3 is an exploded perspective view showing the device for accelerating the combustion of fuel. Referring to the structure thereof shown in FIG. 3, a main body 1 is divided into several compartments using filter screens 101, 102,103 and 104, and a desired number of active spherical bodies 2 are included in the main body 1. The active spherical bodies, which are combustion accelerators, radiate far infrared rays. The combustion accelerator is formed by mixing the components of each active spherical body 2 with metal oxides, such as $TiO_2$, $MnO_2$, $MgO_2$ and the like, or stone powder, which radiates far infrared rays, and then compacting the mixture at high temperatures. In order to activate fuel using a device for accelerating the combustion of fuel including the combustion accelerator, voltage must be applied to the active spherical body 2, and then the active spherical body must come into contact with fuel.

The conventional technologies mentioned above have a common object of improving the combustion efficiency of fuel, but they do not satisfactorily attain the desired effect. Accordingly, it is necessary to provide a device for accelerating the combustion of fuel to realize much higher combustion efficiency, which can increase economical efficiency enough to make up for the cost increase related to the additional provision of the device.

DISCLOSURE

Technical Problem

The present invention has been made to solve the above problems occurring in the prior art, and the present invention is required to maximize the combustion efficiency of fuel by converting liquid fuel into a molecular state, in which liquid fuel easily reacts with oxygen, through a synergetic effect related to the interaction between a magnetic force and a catalyst.

In particular, the present invention is required to accelerate the atomization of fuel due to the radiation of radioactive rays and far infrared rays using a catalyst configured by mixing pure tourmaline ceramic with mixed tourmaline ceramic.

Accordingly, the present invention provides a device for accelerating the combustion of fuel, in which combustion acceleration devices are connected to each other in series or in parallel, so that fuel uninterruptedly flows, thereby improving the combustion efficiency of fuel.

Further, the present invention also provides a system for accelerating the combustion of liquid fuel for internal combustion engines using the device for accelerating the combustion of fuel, in which a catalyst is provided in a fuel tank.

Technical Solution

In order to accomplish the above objects, the present invention provides a device for accelerating combustion of liquid fuel, including a hollow metal pipe; magnets that are provided on upper and lower opposite sides of an inner surface of the metal pipe such that opposite poles thereof face each other and form a closed magnetic circuit; a catalyst that is prepared by mixing pure tourmaline ceramic and mixed tourmaline ceramic, which are formed in a pellet shape, and is introduced into the metal pipe; and connectors which are coupled with both ends of the metal pipe and each of which has an opening at a central portion thereof, wherein activity of the liquid fuel is increased by interaction between a magnetic force formed by the magnets and far infrared rays and radioactive rays emitted from the catalyst, thereby increasing combustion efficiency of the fuel.

Further, the present invention provides a device for accelerating combustion of liquid fuel, which can increase combustion efficiency of fuel, including a plurality of liquid fuel combustion acceleration units, each of which includes a metal pipe, magnets disposed in the metal pipe, a catalyst prepared by mixing pellet-shaped pure tourmaline ceramics and mixed tourmaline ceramics and charged in an interior space of the metal pipe, and connectors coupled to both ends of the metal pipe; and series connecting pipes that continuously connect the plurality of liquid fuel combustion acceleration units in series with each other.

Further, the present invention provides a device for accelerating combustion of liquid fuel, which can increase combustion efficiency of fuel, including a plurality of liquid fuel combustion acceleration units, each of which includes a metal pipe, magnets disposed in the metal pipe, a catalyst prepared by mixing pellet-shaped pure tourmaline ceramics and mixed tourmaline ceramics and charged in an interior space of the metal pipe, and connectors coupled to both ends of the metal pipe; and hubs that continuously connect the plurality of liquid fuel combustion acceleration units in parallel with each other.

Here, each of the hubs is formed in a linear shape or in a circular shape.

Moreover, the present invention provides a system for accelerating combustion of liquid fuel for an internal combustion engine, the internal combustion engine generating power by supplying liquid fuel charged in a fuel tank into a combustion chamber and burning the liquid fuel, including a first combustion acceleration device, which is provided on a fuel pipe connected between the fuel tank and combustion chamber, and which comprises a metal pipe, magnets disposed in the metal pipe, a catalyst prepared by mixing pellet-shaped pure tourmaline ceramics and mixed tourmaline ceramics and charged in an interior space of the metal pipe, and connectors for connection with the fuel pipe, formed at both ends of the metal pipe; and a second combustion acceleration device, which is provided on a fuel outlet formed at a bottom of the fuel tank, and which comprises a housing, having a mesh net shape, and a catalyst, prepared by mixing pellet-shaped pure tourmaline ceramics and mixed tourmaline ceramics, and installed in the housing.

Meanwhile, the pure tourmaline ceramic, used as a catalyst, is formed by pulverizing any one selected from among dravite tourmaline, elbaite tourmaline and schorl tourmaline and then mixing the pulverized tourmaline with water, and the mixed tourmaline, used as a catalyst, is formed by pulverizing any one selected from among dravite tourmaline, elbaite tourmaline and schorl tourmaline, and pulverizing an ore containing $ZrSiO_4$, $FeTiO_3$, $TiO_2$, (Ce, Th, U)$PO_4$ and $YPO_4$, and then mixing the pulverized tourmaline and the pulverized ore with water.

Advantageous Effects

The present invention is advantageous in that liquid fuel is supplied into a combustion chamber after it has been atomized easy combustion, so that the combustion efficiency of fuel can be maximized, with the result that the amount of exhaust gas resulting from the imperfect combustion of fuel can be greatly decreased, thereby contributing to the preservation of the earth's environment.

Further, the present invention is advantageous in that it can contribute greatly to the reduction in fuel consumption because it can be applied to various industrial fields, including the automobile industry.

DESCRIPTION OF THE ELEMENTS IN THE DRAWINGS

Figure 1:
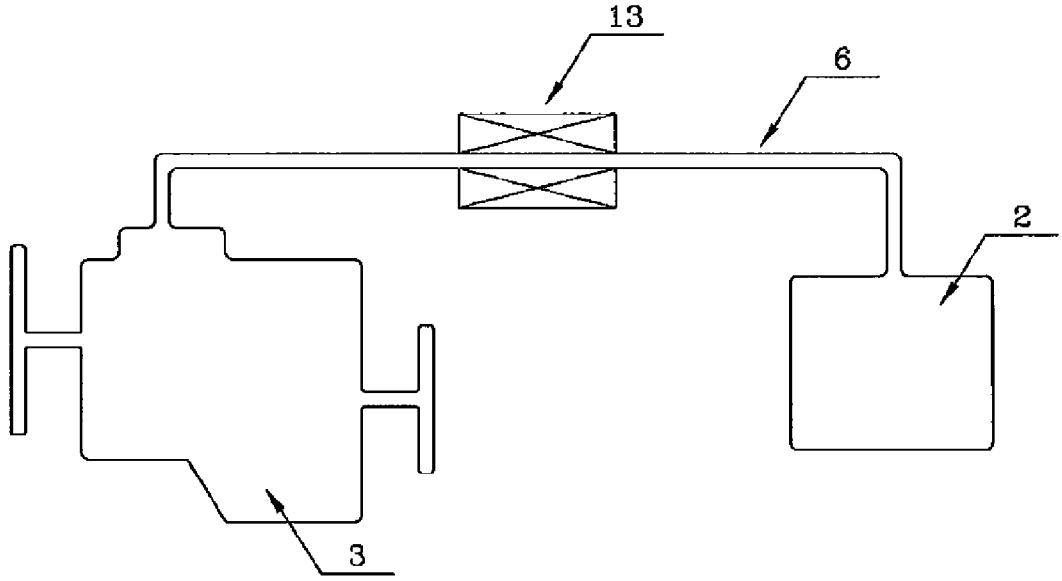
FIG. 1 is a schematic view showing a conventional fuel saving system in which a magnetic field is used to atomize liquid fuel particles.
Figure 2:
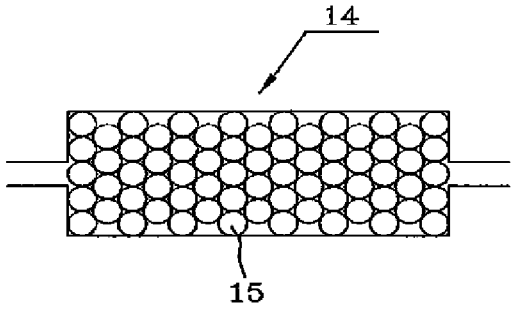
FIG. 2 is a schematic view showing a conventional device for accelerating the combustion of fuel using a catalyst.
Figure 3:
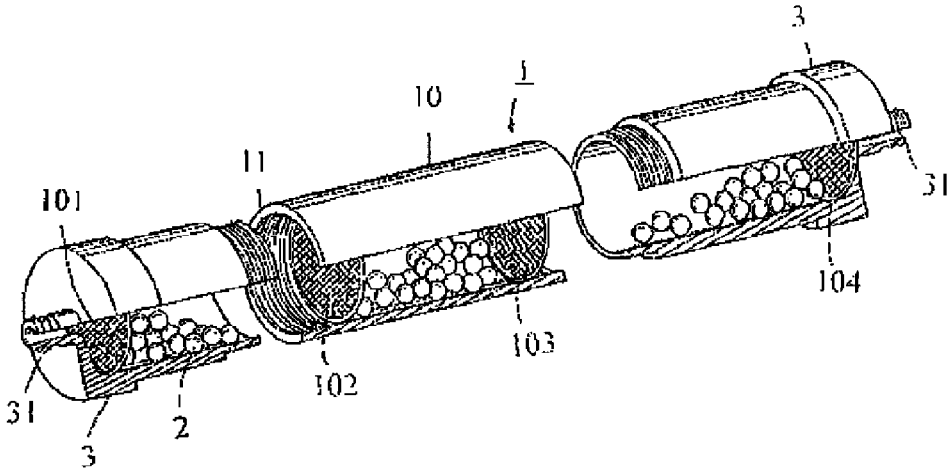
FIG. 3 is an exploded perspective view showing a conventional device for accelerating the combustion of fuel for internal combustion engines.

100: metal pipe
200: magnet
300: catalyst
400: connector
500: liquid fuel combustion acceleration unit
600: series connecting pipe
700: hub
A: first combustion acceleration device
B: second combustion acceleration device
C: third combustion acceleration device
K: combustion chamber
L: fuel tank
M: fuel pipe

BEST MODE

Hereinafter, preferred embodiments of the present invention will be described in detail with reference to the attached drawings in order to facilitate an understanding of the technical idea of the present invention.

Figure 4:
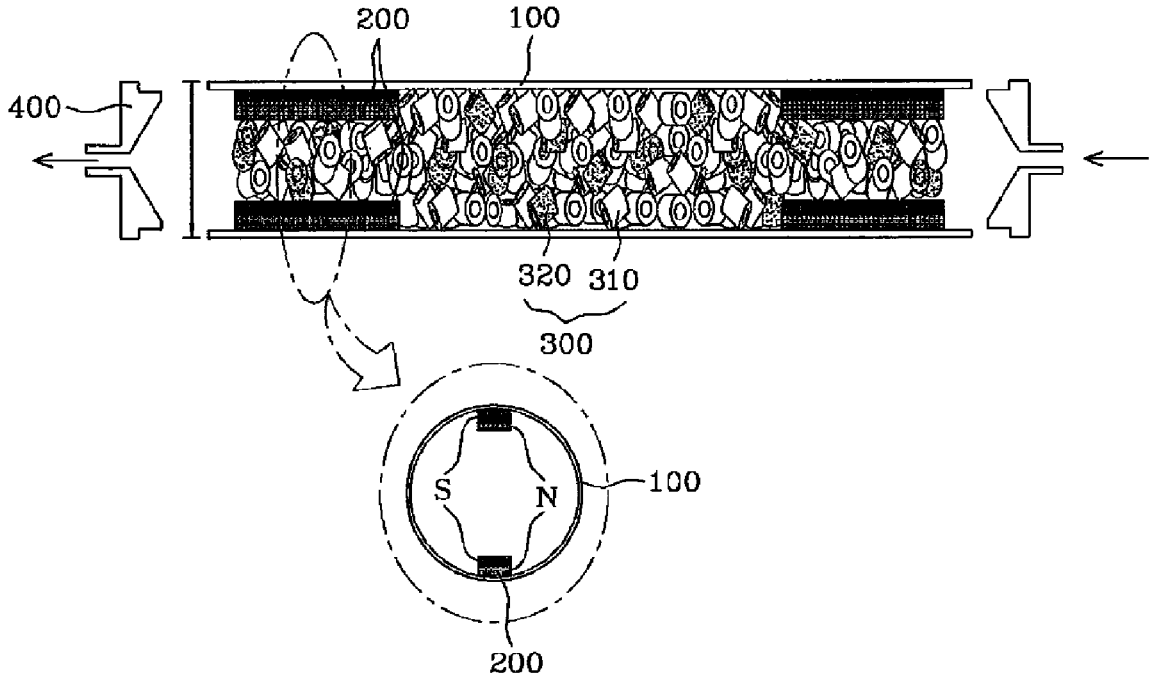
FIG. 4 is a schematic view showing a device for accelerating the combustion of liquid fuel according to a first embodiment of the present invention.

First, a device for accelerating the combustion of liquid fuel (hereinafter, referred to as 'combustion acceleration device') according to a first embodiment of the present invention will be described. FIG. 4 shows a schematic view of the combustion acceleration device of the present invention.

The combustion acceleration device includes a metal pipe 100, magnets 200, a catalyst 300, and connectors 400. The metal pipe 100 is a hollow pipe, both ends of which are open, and is fabricated from ferrous materials. The diameter and length of the metal pipe 100 can be variously changed according to the conditions.

A pair of magnets 200 is disposed on the opposite sides of the inner surface of each of both ends of the metal pipe 100. The pair of magnets 200 has a paramagnetic property, and is disposed such that opposite poles thereof face each other. The magnets used in the present invention may be bar magnets. In the embodiments of the present invention, the pair of bar magnets is installed at diametrically opposed locations in the metal pipe 100 such that they are vertically aligned with each other and opposite poles thereof face each other. In this way, when the magnets 200 are installed in the metal pipe 100, a shielded magnetic field circuit is formed in the metal pipe 100, thereby forming a strong magnetic field in the metal.

Figure 5:
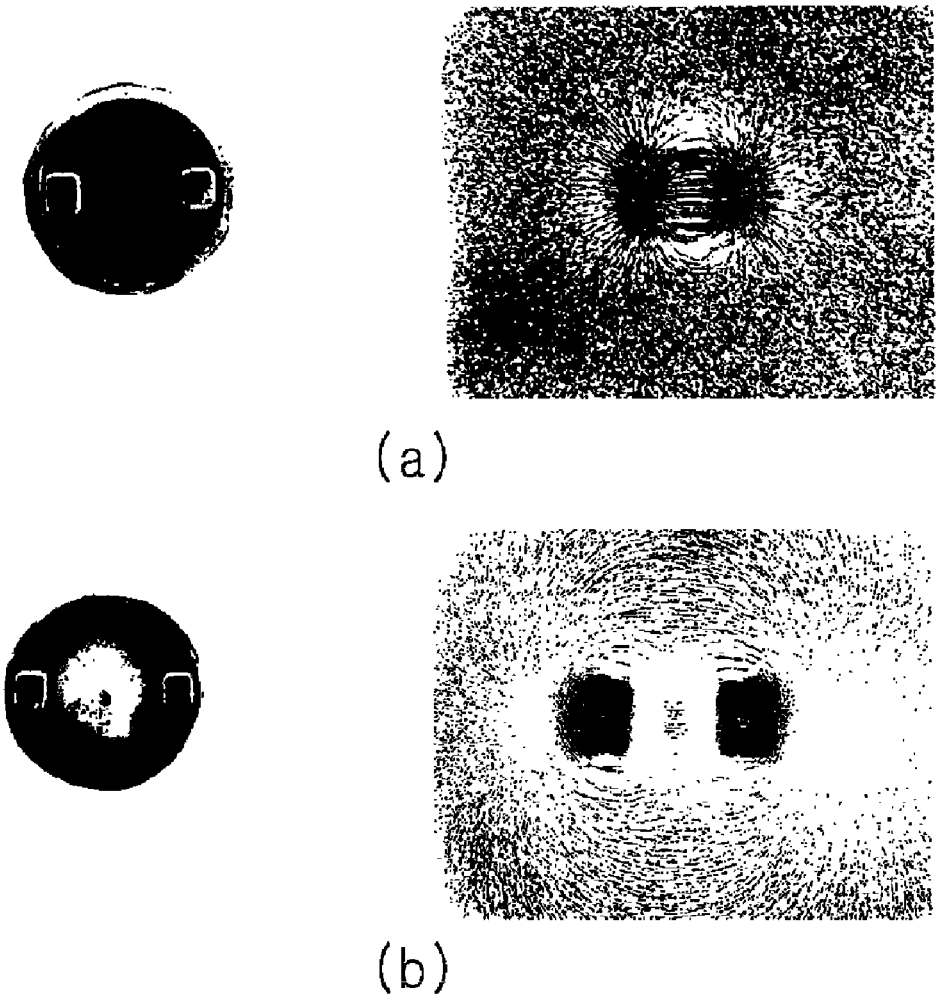
FIG. 5 is photographs showing lines of magnetic force formed in metal pipes manufactured using ferrous metals and nonferrous metals.

FIG. 5 is photographs showing lines of magnetic force formed in metal pipes manufactured using ferrous metals, and in metal pipes using nonferrous metals or materials having no magnetic shielding property. As shown in FIG. 5, in FIG. 5A, it can be seen that a strong magnetic field is formed in the metal pipe made of ferrous metals, on the upper and lower ends of the inner surface of which bar magnets are mounted.

In contrast, in FIG. 5B, it can be seen that a weak magnetic field is formed in a nonferrous metal pipe having no magnetic shielding property. The difference in the magnetic fields of FIG. 5A and FIG. 5B is so great that it can be observed with the naked eye. The magnetic field strength of a bar magnet, as the magnet, may be about 5,000 gauss, and this value may be selected and applied according to the conditions.

Connectors 400 are coupled with both open ends of the metal pipe 100. Each of the connectors 400, in the central portion of which an opening is formed, is connected with a fuel pipe. When the connectors 400 are closely coupled with respective ends of the metal pipe 100, fuel is supplied through one connector coupled with one end of the metal pipe and is discharged through the other connector coupled with the other end of the metal pipe.

A catalyst 300 is introduced into the metal pipe 100, which is closed using the connectors 400, and is thus loaded therein. The catalyst 300 is prepared such that it has a pellet shape, which is a hollow cylinder, and is configured by mixing pure tourmaline ceramics 310 with mixed tourmaline ceramics 320.

The catalyst 300 may be loaded into the metal pipe 100 in an amount suitable for the kind of vehicle. Since the amount thereof is related to the flow rate of fuel, it is preferred that the optimal filling rate be obtained through continuous tests.

The 'pure tourmaline ceramic' (310) constituting the catalyst 300 is formed in a pellet shape by pulverizing any one selected from among dravite tourmaline, elbaite tourmaline and schorl tourmaline, and then mixing the pulverized tourmaline with water. Subsequently, the pellet-shaped pure tourmaline ceramic may be reduced and baked at a temperature of 1,100~1,150° C. for 72 hours or more.

Here, the dravite tourmaline has a molecular formula of $NaMg_3Al_6(BO_3)_3Si_6O_{18}(OH)_4$, the elbaite tourmaline has a molecular formula of $Na(Li_{1.5},Al_{1.5})Al_6(BO_3)_3Si_6O_{18}(OH)_4$, and the schorl tourmaline has a molecular formula of $NaFe^{2+}3Al_6(BO_3)_3Si_6O_{18}(OH)_4$.

The pure tourmaline ceramic is obtained by pulverizing any one selected from among the dravite tourmaline, elbaite tourmaline and schorl tourmaline to a size of 150~350 mesh, mixing and kneading it with water at weight ratio of about 6% to form a mixture having a pellet shape, and then reducing and baking the pellet shaped mixture at a temperature of 1,100~1,150° C. for 72 hours or more.

Further, the 'mixed tourmaline ceramic' is formed by pulverizing any one selected from among dravite tourmaline, elbaite tourmaline and schorl tourmaline, and pulverizing an ore containing $ZrSiO_4$, $FeTiO_3$, $TiO_2$, (Ce, Th, U)$PO_4$ and $YPO_4$, and then mixing the pulverized tourmaline and the pulverized ore with water.

The pure tourmaline ceramics and mixed tourmaline ceramics constituting the catalyst emit electron waves (about 4~14 μm) of far infrared rays, electrons, and weak radioactive rays. Particularly, since far infrared rays, the wavelength of which is matched with the absorption wavelength of fuel molecules, are absorbed in fuel molecules, the fuel molecules resonate with the far infrared rays, and thus the weak force between the fuel molecules is easily dissociated. Since electrons ionize the fuel molecules, they serve to atomize the fuel molecules. Moreover, since weak radioactive rays break carbon-carbon bonds and carbon-hydrogen bonds to thus form very insatiable radicals, they can act to accelerate combustion.

Figure 6:
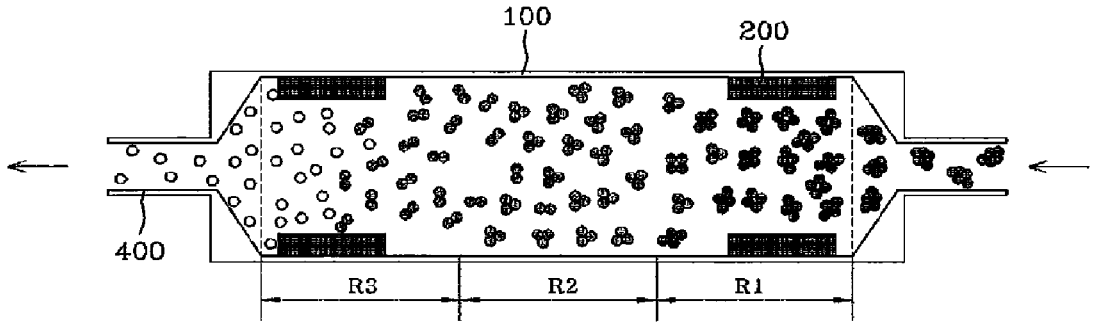
FIG. 6 is a schematic view showing the action principle of the device for accelerating the combustion of liquid fuel.

FIG. 6 is a schematic view showing the action principle of the combustion acceleration device configured as above.

In FIG. 6, fuel, introduced into the combustion acceleration device through one connector 400, becomes liquid clusters due to the weak dispersion force between molecules constituting fuel. These liquid clusters are sprayed without pattern by a fuel spray device, and are then combusted. However, since these clustered hydrocarbons do not sufficiently react with oxygen, some of the clustered hydrocarbons are imperfectly combusted.

According to the combustion acceleration device of the present invention, the introduced liquid fuel can be atomized by the action of the magnet 200 and catalyst 300. In section R1, shown in FIG. 6, fuel is primarily atomized by the decomposition of bonds between fuel molecules, the ionization of fuel molecules, and the formation of radicals, due to the individual actions and collective actions of the catalyst and magnets. Subsequently, the fuel is atomized further while passing through sections R2 and R3. Since the fuel atomized through these procedures can be more easily combined with oxygen in a combustion chamber, the combustion efficiency thereof is increased.

That is, a strong magnetic field is formed by the magnets 200, thereby accelerating the combustion of fuel. Further, fuel is atomized by far infrared rays, electrons, and radioactive rays, which are emitted from the catalyst 300, so that the combination of fuel and oxygen is smoothly induced, thereby accelerating the combustion of fuel. Moreover, greater induced currents are generated due to the interaction between the catalyst 300 and the magnets 200, thereby accelerating the combustion of fuel.

Figure 7:
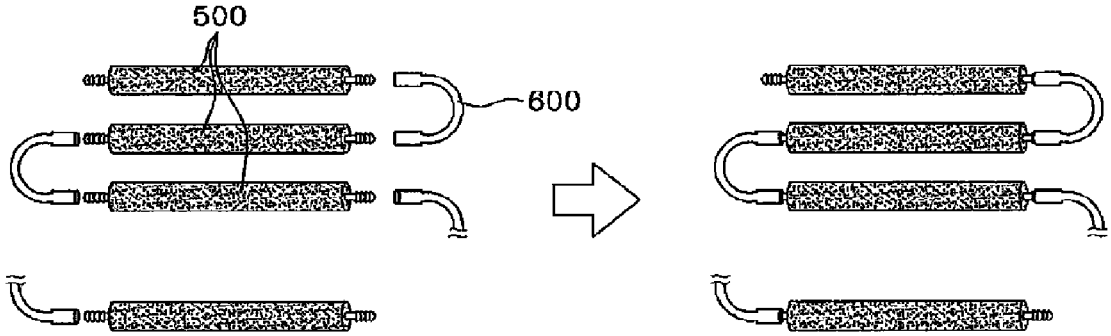
FIG. 7 is a perspective view showing a device for accelerating the combustion of liquid fuel according to a second embodiment of the present invention.

Next, a second embodiment of the present invention will be described in detail. FIG. 7 is a perspective view showing a combustion acceleration device according to the second embodiment of the present invention.

The combustion acceleration device according to the second embodiment of the present invention is characterized in that the plural liquid fuel combustion acceleration devices described in the first embodiment of the present invention are connected in series with each other. Here, each of the liquid fuel combustion acceleration devices is referred to as 'a liquid fuel combustion acceleration unit 500'.

The liquid fuel combustion acceleration unit 500 is configured such that magnets 200 are disposed on the opposite sides of the inner surface of a metal pipe 100, a catalyst, configured by mixing pure tourmaline ceramics with mixed tourmaline ceramics, each of which has a pellet shape, is placed Inside the metal pipe 100, and connectors 400 are coupled to both ends of the metal pipe 100.

The plurality of liquid fuel combustion acceleration units 500 configured above, as shown in FIG. 7, are connected in series with each other using U-shaped series connecting pipes 600. When several liquid fuel combustion acceleration units 500 are provided, the flow resistance of fuel can be decreased because the amount of the catalyst 300 that is introduced into one liquid fuel combustion acceleration unit 500 can be decreased, and the atomization of fuel molecules can be promoted because the time period of contact time between the fuel and the catalyst is increased. That is, this combustion acceleration structure can be applied to large-sized vehicles.

Figure 8:
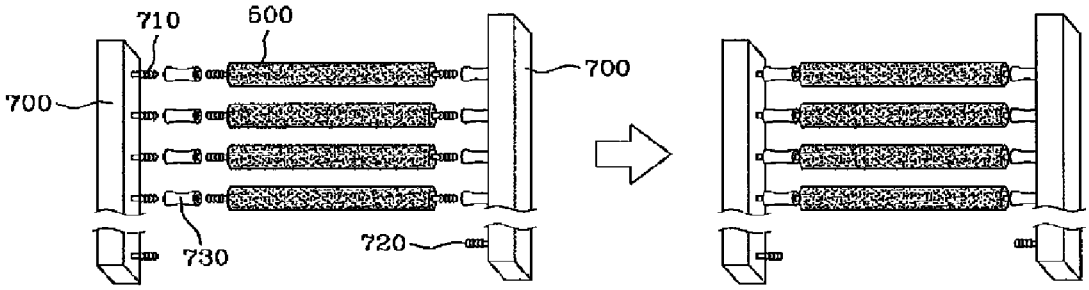
FIG. 8 is a perspective view showing a device for accelerating the combustion of liquid fuel according to a third embodiment of the present invention.
Figure 9:
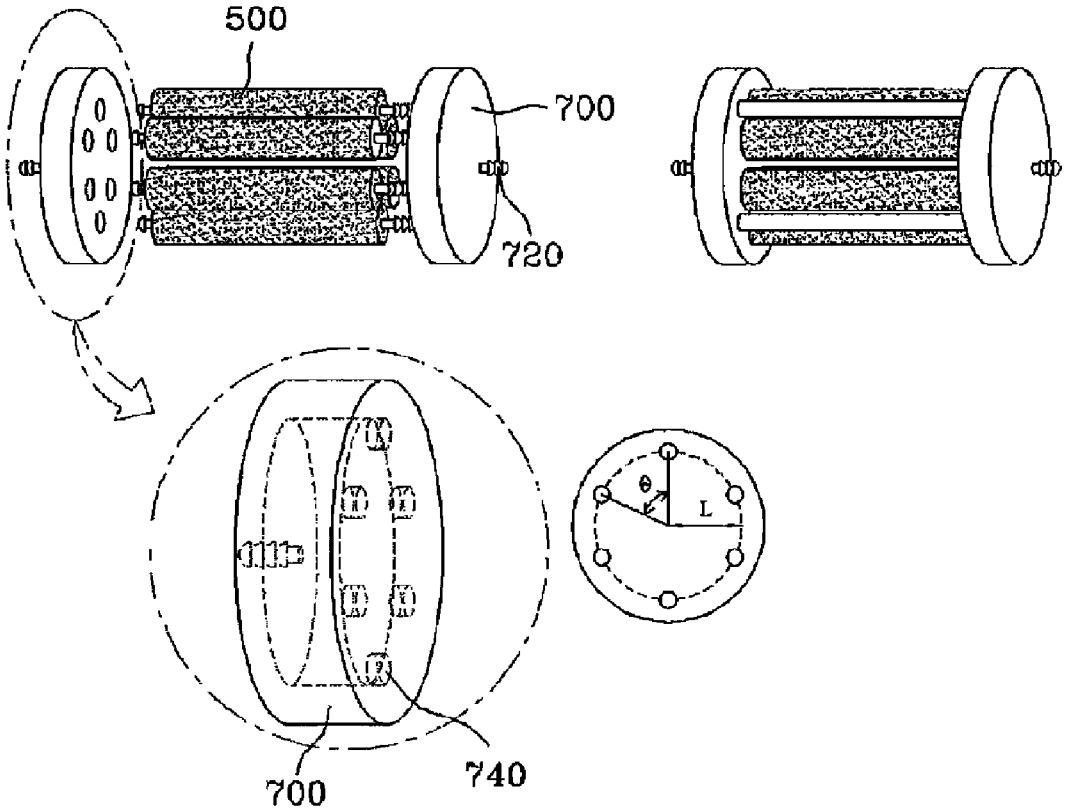
FIG. 9 is a perspective view showing a device for accelerating the combustion of liquid fuel according to a fourth embodiment of the present invention.

Subsequently, a third embodiment of the present invention will be described in detail. FIG. 8 is a perspective view showing a combustion acceleration device according to the third embodiment of the present invention.

The combustion acceleration device according to the third embodiment of the present invention is characterized in that the plural liquid fuel combustion acceleration units 500, described in the second embodiment of the present invention, are connected in parallel with each other. The combustion acceleration device further includes hubs 700 which connect the liquid fuel combustion acceleration units in parallel with each other.

Particularly, in the third embodiment of the present invention, as shown in FIG. 8, linear hubs are used as the hubs. The liquid fuel combustion acceleration units 500 are the same as those configured above. In order to connect the liquid fuel combustion acceleration units 500 in parallel with each other, the hubs 700 are connected to both left and right ends of respective units.

The linear hub 700 is formed of a rectangular tube, and has a plurality of hub connectors 710, which are connected with the connectors 400 of the liquid fuel combustion acceleration units 500, on an inner surface thereof. The hub connectors 710 are connected to the connectors 400 using rubber tubes 730. Meanwhile, fuel pipe connectors 720, which are connected to a fuel pipe M and serve to supply and discharge fuel, are formed in the lower inner surfaces of respective hubs 700.

Since fuel is supplied into the hub 700 through the fuel pipe connector 720, is discharged through the plurality of hub connectors 710, and is then distributed to each of the liquid fuel combustion acceleration units 500, a large amount of fuel can be effectively activated all at once.

The combustion acceleration device according to the fourth embodiment of the present invention is characterized in that the liquid fuel combustion acceleration units 500 are connected in parallel with each other, and are disposed in a circle to be connected with circular hubs 700.

A plurality of connection holes 740, which are connected with the connectors 400, is circularly formed in the inner surface of the circular hub 700, and a fuel pipe connector 720 is mounted on the central outer surface thereof. Since each of the circular hubs has a space therein, fuel supplied through the fuel pipe connector 720 is uniformly distributed to each of the liquid fuel combustion acceleration units 500, flows thereto, is collected in the opposite hub, and is then discharged through the fuel pipe connector 720.

Hereinafter, a system for accelerating the combustion of liquid fuel, which is configured using the liquid fuel combustion acceleration device according to an embodiment of the present invention, will be described in detail.

Figure 10:
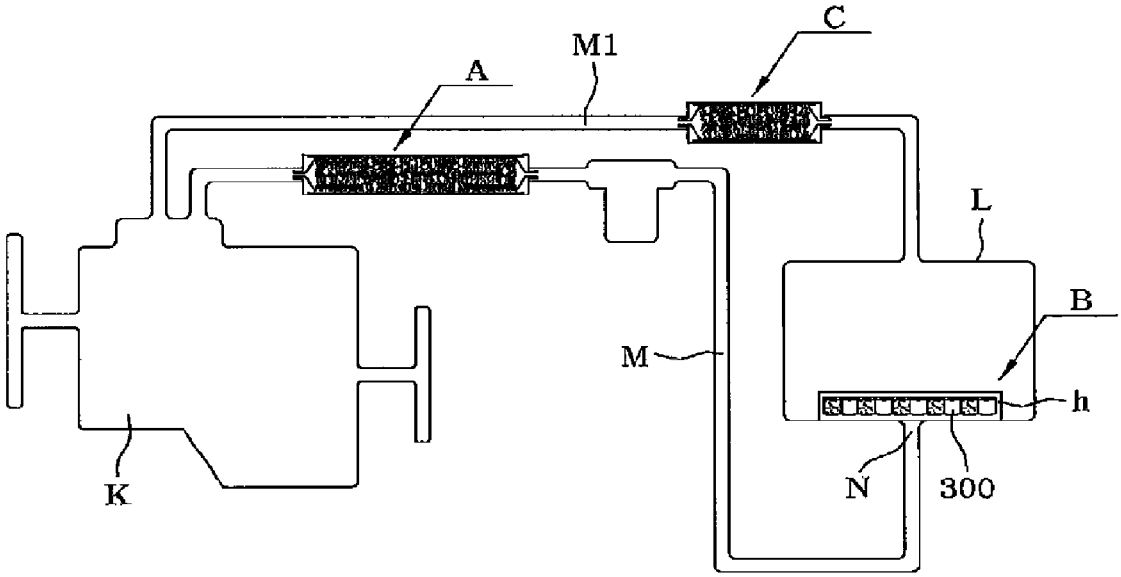
FIG. 10 is a schematic view showing a system for accelerating the combustion of liquid fuel according to an embodiment of the present invention.

FIG. 10 is a schematic view showing a system for accelerating the combustion of liquid fuel according to an embodiment of the present invention. The system basically includes a combustion chamber K, in which fuel is combusted, and a fuel tank L, and further includes a first combustion acceleration device A and a second combustion acceleration device B.

The first combustion acceleration device A is mounted on a fuel pipe M, through which the combustion chamber K and the fuel tank L are interconnected. The first combustion acceleration device A is configured such that magnets 200 are provided in a metal pipe 100, a catalyst, configured by mixing pure tourmaline ceramics with mixed tourmaline ceramics, each of which has a pellet shape, is charged in the metal pipe 100, and connectors 400, connected with the fuel pipe M, are coupled with both ends of the metal pipe 100.

Since the first combustion acceleration device and its relationship with the liquid fuel combustion acceleration device described above have already been described in detail, here, the description of the first combustion acceleration device will be omitted.

Meanwhile, the fuel tank L is provided therein with a second combustion acceleration device B. As shown in FIG. 10, the second combustion acceleration device B is provided on a fuel outlet N formed in the bottom of the fuel tank L. The second combustion acceleration device B includes a housing H defining a space therein using mesh nets and a catalyst 300 provided in the housing H. The catalyst 300 is the same as that used in the first combustion acceleration device A, and is formed of pure tourmaline ceramics and mixed tourmaline ceramics.

If necessary, a third combustion acceleration device C, as another combustion acceleration device, may be provided in an unburned fuel circulation pipe Ml, which connects a combustion chamber K to a fuel tank L. The third combustion acceleration device C may be a structure in which a catalyst is placed in a metal pipe, and need not include magnets.

According to the system for accelerating the combustion of liquid fuel, configured above, in order to accelerate the combustion of fuel, fuel molecules are atomized by the catalyst 300 included in the second combustion acceleration device B provided in the fuel tank L, and then flow out. Subsequently, the fuel molecules are further atomized, and thus activated, by the interaction between magnetic force and the catalyst in the first combustion acceleration device A while they pass through the fuel pipe M. The unburned fuel is atomized still further by the third combustion acceleration device C, thereby contributing to the acceleration of the combustion of fuel.

Hereinafter, results of tests of the system for accelerating the combustion of liquid fuel, configured to use the liquid fuel combustion acceleration device according to the present invention, will be described.

Test Example 1

In Test Example 1, a catalyst including forty pure ceramic pellets and five mixed ceramic pellets was introduced into a metal pipe, and two pairs of bar magnets having a magnetic flux density of 5,000 gauss were provided on ends of the inner surface of the metal pipe, thereby constituting a first combustion acceleration device A. A third combustion acceleration device C was provided on an unburned fuel circulation pipe, and a catalyst including only ten pure ceramic pellets was introduced thereinto.

This test was conducted by Nippon Freedom corp. The engine used in this test was a diesel engine (type: LD20T-II (1996-NISSAN CARAVAN), compression ratio: 21.3, maximum power: 70PS/4400 rpm, inner diameter×stroke: 85 mm×86 mm) manufactured by Nissan Motor Co. Ltd. As for engine control, engine speed, engine load, and the like were controlled using a water-cooled current dynamometer manufactured by Nippon Tokyo Meta Co. Ltd. The main standards and calculation method of the dynamometer are given in Table 1. The results of measuring fuel in a normal state (normal fuel) and a state in which fuel has been passed through the combustion acceleration devices (treated fuel), depending on the engine speed and engine load, is given in Table 2.

From the test results, it was found that the fuel consumption rate was improved depending on each pattern in each of the engine speed and engine load. It was found that the fuel saving ratio, at an engine load of 10 Kgf, was 15.6% at an engine speed of 1,000 rpm, 10.9% at an engine speed of 1,500 rpm, and 7.9% at an engine speed of 2,000 LIAR. Therefore, it could be seen that the fuel saving ratio was high in the case of a low engine speed (low-speed running). The engine speed of 1,000 rpm, used in this test, corresponds to a vehicle speed of about 36 km/h, 1500 rpm corresponds to a vehicle speed of about 54 km/h, and 2000 rpm corresponds to a vehicle speed of about 72 km/h. It could be seen that this speed range is the most commonly-used range, and that the fuel consumption ratio of a vehicle is improved by about 7-10% in this range. It is determined that the cause of the test results is that the bonds between fuel molecules are dissociated by a magnetic field generated by magnets and by far infrared rays, anions and radioactive rays radiated from a catalyst while fuel passes through the combustion acceleration device of the present invention, and thus the fuel is changed so that it is more readily combusted.

TABLE 1

| Power absorption method | Amperometric method | Absorbed engine power (MAX) | 150PS |
|---|---|---|---|
| Type | EW-150EP | dynamometer | Automatic pendulum balance |
| Absorbed engine speed (MAX) | 9000 rpm | Capacitive fuel ratio meter | Counting Time signal 0.1 S |

Method of calculating test results: Fuel consumption rate [g/kw · h] is calculated using the fuel consumption amount, time, engine speed and engine load in a normal state (normal fuel) and a state (treated fuel) in which fuel is passed through the combustion acceleration device.

$\eta\tau = (3{,}600\ V \cdot \gamma)/(t \cdot P)$ $\eta\tau$: fuel consumption rate [g/kw · h]

V: fuel consumption rate [CC]

$\gamma$: specific gravity of fuel t: fuel consumption time [S]

P: engine power [kw]

$P = T \cdot \omega$ (T: engine torque [Nm,], $\omega$: angular velocity [rad/s] $\omega = 2\chi N/60$)

$T = F*R$ (F: engine load [k g f], R: dynamometer length [m])

Thermal efficiency is calculated in addition to fuel consumption rate.

$\eta\tau$ = input/output = Pi/Po: (kw · h)/g = $(Po*10^3*3{,}600)/(Vg * 10^{-3}* G r * 106)$ Po: output [kw]

Vg: fuel consumption [g]

Gr: calorific value of fuel (diesel oil)

TABLE 2

| | | Fuel in normal state | | Fuel in a state in which devices are provided | | |
|---|---|---|---|---|---|---|
| | Engine speed (rpm) | Fuel consumption rate (g/kWh) | Thermal efficiency (%) | Fuel consumption rate (g/kWh) | Thermal efficiency (%) | Fuel saving ratio (%) |
| (1) engine load (engine rotation at a load of 10 kgf) | 1,000 | 336.3 | 25.2 | 283.9 | 29.8 | 15.6 |
| | 1,500 | 332.0 | 25.2 | 295.9 | 28.6 | 1.9 |
| | 2,000 | 329.8 | 25.7 | 303.7 | 27.9 | 7.9 |
| (2) engine load (engine rotation at a load of 10 kgf) | 1,000 | 291.7 | 29.0 | 256.8 | 33.0 | 12.0 |
| | 1,500 | 285.9 | 29.6 | 248.6 | 34.1 | 13.0 |
| | 2,000 | 268.8 | 29.5 | 257.9 | 32.9 | 10.1 |
| (3) engine load (engine rotation at a load of 10 kgf) | 1,000 | 283.1 | 29.9 | 251.1 | 33.7 | 11.3 |
| | 1,500 | 266.0 | 31.8 | 240.7 | 35.2 | 9.5 |
| | 2,000 | 264.7 | 32.0 | 245.1 | 34.6 | 7.4 |

Test Example 2

Test Example 2 relates to the results of conducting real running tests by directly applying the present invention to a vehicle.

A car (SM520, Automatic, 2000 year' type), manufactured by Renault Samsung Motors, was used as a test vehicle. As fuel, lead-free gasoline was used. Here, the system for accelerating the combustion of liquid fuel for an internal combustion engine using the liquid fuel combustion acceleration device according to the present invention is referred to as 'ADC'.

In the ADC, 180 catalyst pellets were introduced into a cylindrical container made of iron, a first combustion acceleration device A was formed of four magnets, forty catalyst pellets were introduced into a third combustion acceleration device C provided on an unburned fuel circulation pipe, and 100 catalyst pellets were introduced into a second combustion acceleration device B provided in a fuel tank L. The results of real running tests conducted using a vehicle employing the ADC of the present invention and a vehicle employing a general system for accelerating the combustion of liquid fuel were given in Table 3. From the results of conducting real running tests, it can be seen that the ADC of the present invention realized excellent performance, and that, as the amount of the catalyst is increased, fuel is increasingly atomized and activated, thereby greatly increasing the fuel consumption ratio of a vehicle.

TABLE 3

| Installed or uninstalled | * average vehicle speed (km/h) | Travel distance (km) | Fuel consumption (l) | Fuel consumption rate (km/l) | *** remark |
|---|---|---|---|---|---|
| ** Uninstalled | 100 | 570.2 | 51.4 | 11.3 | Official fuel consumption rate described in automobile registration (11 km/l) |
| | | 511.1 | 46.5 | 11.1 | |
| | | 519.3 | 45.6 | 11.4 | |
| | | Measured average fuel consumption rate | | 11.3 | |
| *** ADC-1 installed | 100 | 185.5 | 11.1 | 16.7 | Fuel saving ratio 45.1(49.1)% |
| | | 447.5 | 27.8 | 16.1 | |
| | | 447.5 | 27.3 | 16.4 | |
| | | 185.5 | 11.1 | 16.7 | |
| | | 745.2 | 46.1 | 16.2 | |
| | | Measured average fuel consumption rate | | 16.4 | |
| | 110 | 185.4 | 11.9 | 15.6 | Fuel saving ratio 37.1(40.9)% |
| | | 599.5 | 38.8 | 15.5 | |
| | | 186.6 | 11.9 | 15.7 | |
| | | 447.5 | 29.1 | 15.4 | |
| | | 447.6 | 29.3 | 15.3 | |
| | | Measured average fuel consumption rate | | 15.5 | |
| | 120 | 451.8 | 31.1 | 14.5 | Fuel saving ratio 26.5(30.0)% |
| | | 185.4 | 13.7 | 13.5 | |
| | | 447.8 | 30.2 | 14.8 | |
| | | Measured average fuel consumption rate | | 14.3 | |

Explanatory notes

* Average vehicle speed is a speed measured on an expressway.

** In the case where ADC is not installed (test running period: 2004 Aug. 19-2004 Dec. 30)

*** In the case where ADC is installed (test running period: 2004 Dec. 30-now)

**** values in parentheses in the remark column are values for comparison with official fuel consumption rate.

Test Example 3

Test Example 3 relates to the results of conducting real running tests using a trailer truck. Here, diesel oil was used as fuel, and several first combustion acceleration devices A were connected in series or in parallel with each other to be suitable for large-sized vehicles. A system for accelerating the combustion of liquid fuel, configured as such, is referred to as 'SADC'.

In this test, 210 catalyst pellets were introduced into one liquid fuel combustion acceleration unit 500 constituting the first combustion acceleration device A, 80 catalyst pellets were introduced into the third combustion acceleration device C, and 500 catalyst pellets were introduced into the second combustion acceleration device B. The results of comparative tests are given in Table 4.

The invention claimed is:

1. A device for accelerating combustion of liquid fuel, comprising:

a hollow metal pipe;

magnets provided on upper and lower opposite sides of an inner surface of the metal pipe such that opposite poles thereof face each other and form a closed magnetic circuit;

a catalyst prepared by mixing pure tourmaline ceramic and mixed tourmaline ceramic, formed in a pellet shape, and introduced into the metal pipe; and connectors which are coupled with both ends of the metal pipe and each of which has an opening at a central portion thereof, wherein the pure tourmaline ceramic is formed by pulverizing any one selected from among dravite tourmaline,

TABLE 4

| Vehicle registration No. | Installed or uninstalled | Running period | Travel distance (km) | Fuel consumption (l) | Fuel consumption rate (km/l) | Fuel saving ratio (%) |
|---|---|---|---|---|---|---|
| * 7734 | uninstalled | 2005 January-2005 June | 55,583 | 25,998 | 2.138 | 18.3 |
| | Parallel SADC installed | 2006 Feb. 04-2006 Apr. 30 | 30,007 | 11,863 | 2.529 | |
| ** 7712 | uninstalled | 2005 January-2005 June | 49,063 | 24,332 | 2.039 | 16.8 |
| | Series SADC installed | 2006 Feb. 04-2006 Apr. 30 | 25,935 | 10,891 | 2.381 | |

Explanatory notes

* test trailer truck: Daewoo, 2001 year' type, 14,000 cc, 420 horsepower, Korea V Express corp., vehicle registration No. 7734

** test trailer truck: Daewoo, 1997 year' type, 12,000 cc, 370 horsepower, Korea V Express corp., vehicle registration No. 7712 elbaite tourmaline and schorl tourmaline and then mixing the pulverized tourmaline with water, wherein the mixed tourmaline is formed by pulverizing any one selected from among dravite tourmaline, elbaite tourmaline and schorl tourmaline, and pulverizing an ore containing $ZrSiO_4$, $FeTiO_3$, $TiO_2$, (Ce, Th, U)$PO_4$ and $YPO_4$, and then mixing the pulverized tourmaline and the pulverized ore with water, and wherein activity of the liquid fuel is increased by interaction between a magnetic force formed by the magnets and far infrared rays and radioactive rays emitted from the catalyst, thereby increasing combustion efficiency of the fuel.

* * * * *